US010316588B1

(12) United States Patent
Robertson et al.

(10) Patent No.: US 10,316,588 B1
(45) Date of Patent: Jun. 11, 2019

(54) PIPE SHAKER APPARATUS FOR HORIZONTAL AND VERTICAL DRILLING APPLICATIONS

(71) Applicant: Dandelion Energy, Inc., Palo Alto, CA (US)

(72) Inventors: Kenneth Robertson, San Jose, CA (US); Bruce Allen Eisenhauer, Jr., San Jose, CA (US); Luuk Sasse, Mountain View, CA (US)

(73) Assignee: Dandelion Energy, Inc., Palo Alto, CA (US)

( * ) Notice: Subject to any disclaimer, the term of this patent is extended or adjusted under 35 U.S.C. 154(b) by 210 days.

(21) Appl. No.: 15/389,787

(22) Filed: Dec. 23, 2016

(51) Int. Cl.

| | |
|---|---|
| ***E21B 7/24*** | (2006.01) |
| ***F01D 1/04*** | (2006.01) |
| ***F01D 15/00*** | (2006.01) |
| ***E21B 7/20*** | (2006.01) |
| *E21B 1/00* | (2006.01) |

(52) U.S. Cl.
CPC ..... *E21B 7/24* (2013.01); *E21B 7/20* (2013.01); *F01D 1/04* (2013.01); *F01D 15/00* (2013.01); *E21B 1/00* (2013.01)

(58) Field of Classification Search
CPC ..... E21B 31/005; E21B 7/24
See application file for complete search history.

(56) References Cited

U.S. PATENT DOCUMENTS

| | | | | |
|---|---|---|---|---|
| 2,340,959 | A | 2/1944 | Harth | |
| 2,641,927 | A | 6/1953 | Grable et al. | |
| 2,951,681 | A | 9/1960 | Wilhelm | |
| 3,076,513 | A | 2/1963 | Heaphy | |
| 2005/0121231 | A1* | 6/2005 | Clayton | E21B 7/24 175/55 |

* cited by examiner

*Primary Examiner* — D. Andrews
(74) *Attorney, Agent, or Firm* — Fountainhead Law Group P.C.

(57) ABSTRACT

A pipe shaker apparatus is configured to shake within a pipe and cause the pipe to vibrate. The pipe shaker apparatus includes a rotor having an offset mass. The offset mass is offset from a longitudinal axis through a first end piece of the rotor at a first end of the rotor and a second end piece of the rotor at a second end of the rotor. The pipe shaker apparatus also includes a tubular body having first and second ends. First and second end caps are arranged at first and second ends of the tubular body such that air is able to pass through the first end cap, enter the tubular body, cause the rotor to rotate, and exit the tubular body through the second end cap. The rotor is arranged such that rotation of the rotor by the air cases the offset mass to shake the pipe shaker apparatus.

20 Claims, 17 Drawing Sheets

PIPE SHAKER APPARATUS FOR HORIZONTAL AND VERTICAL DRILLING APPLICATIONS

BACKGROUND

One approach for placing underground piping, commonly called "mole drilling," includes using an impact hammer to create an opening for a pipe. The impact hammer may be used inside a pipe or may tow the pipe along while drilling. The impact hammer is powered by a compressed air supplied by an air hose and impacts a drilling head (which may be, for instance, a metal such as steel or steel alloys) fastened to the end of the pipe. The impacting creates an opening in the ground and drives the pipe downward (when drilling vertically) or through (when drilling horizontally) into the ground. At the same time, the drilling head and/or impact hammer drags the pipe into the opening. When the target depth or length is reached, the air hose and impact hammer are pulled out of the pipe, leaving the drilling head in the ground at the end of the pipe. This pipe can now be used in various ways such as electrical, gas or water conduits, geothermal loops, etc.

However, when hammering the pipe into the ground, there can be significant friction forces applied to the outside of the pipe by the by the ground material around the pipe as shown in FIG. 1. In this example, ground material 100 causes friction forces (represented by arrows 110-117) which can slow the progression of pipe 120 and drill 130 through the ground material. This is especially true when the pipe is going into the water table as the wet soil compacts more around the pipe. In some cases, the ground friction forces can be so great, these forces can dramatically slow down the drilling process or even keep the pipe from advancing through the opening at all.

BRIEF SUMMARY

One aspect of the disclosure provides a system including a pipe shaker apparatus configured to shake within a pipe to cause the pipe to vibrate. The pipe shaker apparatus includes a rotor having an offset mass. The offset mass is offset from a longitudinal axis through a first end piece of the rotor at a first end of the rotor and a second end piece of the rotor at a second end of the rotor, and the first end and second ends of the rotor are opposite one another. The pipe shaker apparatus also includes a tubular body having first and second ends, a first end cap arranged at the first end of the tubular body, and a second end cap arranged at the second end of the tubular body. The first and second end caps are arranged such that air is able to pass through the first end cap, enter the tubular body, cause the rotor to rotate, and exit the tubular body through the second end cap. In addition, the rotor is arranged within the tubular body such that rotation of the rotor by the air causes the offset mass to shake the pipe shaker apparatus.

In one example, the rotor is arranged such that an area between the first end piece and the second end piece creates a void between the offset mass and an interior surface of the tubular body. In another example, the rotor includes a slot extending through and between each of the first and second end pieces. In this example, the system also includes a vane arranged within the slot such that air passing through the tubular body causes the vane to sweep against an interior surface of the tubular body which causes the rotor to rotate.

In another example, the first end piece includes a cylindrical extension having an opening there through, and the second end piece includes a cylindrical extension having an opening there through. In this example, the opening of the first cylindrical extension is connected to the opening in the second cylindrical extension by way of a set of passages. In addition or alternatively, the system also includes an air blocking structure arranged to block one of the set of passages in order to limit air passing directly through the opening of the first cylindrical extension to the opening in the second cylindrical extension by way of the set of passages.

In another example, a first end of the pipe shaker apparatus includes a first quick connect device and a second end of the pipe shaker apparatus includes a second quick connect device. In this example, the system also includes an air hose having a third quick connect device such that the air hose and the pipe shaker apparatus are configured to be connected to one another by way of the first and third quick connect devices. In addition or alternatively, the system also includes a set of compressed air hose sections wherein the first quick connect device and the second quick connect device allow the pipe shaker apparatus to be connected in line with the set of compressed air hose sections.

In another example, the system also includes the pipe. In this example, a greatest diameter of the pipe shaker apparatus is configured to be smaller than a greatest internal diameter of the pipe such that the pipe shaker apparatus can move freely within the pipe. In addition or alternatively, the system includes a spring loaded feature attached to the pipe shaker apparatus such that the spring loaded extends away from the pipe shaker apparatus and towards an interior surface of the pipe. In addition or alternatively, the spring loaded feature is configured to be moved towards the interior surface by compressed air. In some examples, the system also includes a drilling head attached to the pipe.

In another example, the system also includes a pair of rotor propellers fixed to the rotor such that rotation of the pair of rotor propellers causes the rotor to rotate with the pair of rotor propellers. In this example, each rotor propeller of the pair of rotor propellers is adjacent to a respective stator propeller. In addition or alternatively, each respective stator propeller is attached to a stator bracket that connects to one of the first or second end caps. In addition or alternatively, each stator bracket includes a pair of rings connected to one another by a linear support. In addition or alternatively, the system also includes a ball bearing connecting one of the respective stator propellers to one of the rotor propellers to allow the one of the pair of rotor propellers to rotate within the one of the respective stator propellers.

DETAILED DESCRIPTION

Overview

Figure 1:
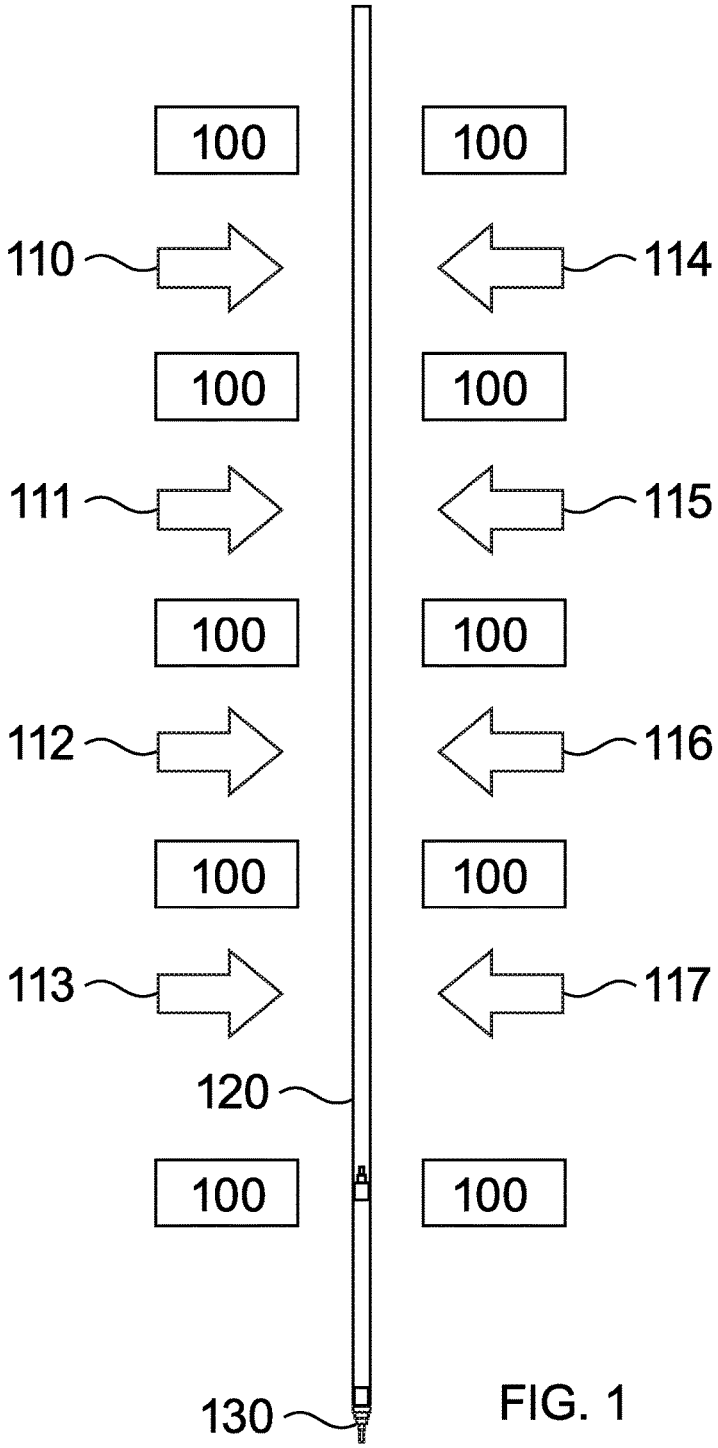
FIG. 1 is an example view of a pipe and drill head in ground material in accordance with aspects of the disclosure.

Aspects of the technology relate to pipe shaker apparatuses for use with the placement of underground piping, such as that used for electrical cables, fiber optic cables, gas conduits (steam, natural gas, propane, etc.), liquid conduits (water, refrigerant, etc.), sewage conduits, etc. An example system for placing underground piping may include a pipe, a drill head, a boring tool, an air compressor, air hose, and one or more pipe shaker apparatus. To create an opening in ground material and place the pipe, the boring tool, one or more pipe shakers, and air hose may be inserted into the pipe. For instance, the boring tool and one or more pipe shakers may then be powered by compressed air through air hose from the air compressor. The drill head and boring tool then creates the opening in the ground material, pulling the pipe along with the boring tool.

The pipe shaker apparatus may be sized to fit within the pipe. The pipe shaker apparatus includes opposing first and second ends of a tubular body. The first and second ends are each attached to a threaded end cap. Threading may connect the threaded end caps to an internal surface of the tubular body which may or may not include complementary threading. The threaded end caps are each attached via internal threading (not shown) to threading of a connection device. The threaded end caps have openings which allow air to pass through and are configured hold an offset mass within the tubular body.

An example pipe shaker apparatus can be configured to connect in line with the air hose. In this regard, the connection devices may be a quick connect fittings. These quick connect fitting may be attached via threading to a portion of the air hose (not shown). The quick connect fitting may allow each end of the pipe shaker apparatus to connect with a corresponding connection device. In this regard, a plurality of pipe shaker apparatus can be connected in line with the compressed air hose quickly and easily.

Within the tubular body is an offset mass attached to each of the threaded end caps. The offset mass may be configured as a rotor having a generally cylindrical shape. In this regard, the shape of the rotor includes two circular end pieces connected to one another by an extension. The relative arrangement of the extension between the circular end pieces creates the offset mass of the rotor. When the rotor is within the tubular body, the area apart from the circular end pieces and extension forms a void between the rotor and the tubular body.

Each circular end pieces includes a cylindrical extension that extends away from the circular end pieces and has an opening there through. The openings are connected via a series of internal passages. To allow for the vane to rotate the rotor, a portion of one of the internal passages may be blocked in order to force air into the so that the air moves around the vane. To allow for placement of the vane, the rotor may include a slot which may pass through both of the circular end pieces as well as the extension.

Compressed air may be forced through the quick connect fitting and thereafter enters and moves through the opening of threaded end cap and into the tubular body. From the opening, the air passes through the opening in the cylindrical extension. The air then moves through one or more of the internal passages and around the extension. The air moving around the extension then creates a force on the vane which deflects some of the air. The force on the vane caused by the moving air moves the vane which sweeps against the inner wall of the tubular body. At the same time, the vane pulls the rotor along with the vane such that both the vane and the rotor rotate. The deflected air continues to move around the extension until it exits the pipe shaker apparatus through the opening of the other threaded end cap.

In other examples, rather than using a vane, the rotor may include one or more rotor propellers. In this example, compressed air moving through the pipe shaker apparatus may be deflected towards blades of the one or more rotor propellers. The force of the air on the one or more rotor propellers causes the one or more rotor propellers to rotate, which causes the rotor to rotate as well.

One or more pipe shaker apparatus may be connected to quick connect devices of a portion of air hose and inserted into pipe in order to reduce the friction between the pipe and the ground material. Rotation of the rotor, causes the pipe shaker to "wobble" within the pipe. This motion causes the pipe shaker apparatus to come in contact with the interior of the pipe vibrating the pipe and the ground material surrounding the pipe. The vibrations reduce friction between the pipe and the ground thereby making it easier for the pipe to move through the opening created by the drilling head.

The features described herein provide low cost, efficient pipe shaker apparatus devices which do not create too much of a pressure drop. This is critical so that the air pressure at the impact hammer (necessary to create the opening) is not greatly reduced. The reduction in friction, without the reduction in air pressure, can greatly increase the rate of penetration of the drilling head through the ground. As such, the desired depth of drilling may be reached much sooner than without the pipe shaker apparatus.

Example Systems

An example system for placing underground piping may include a pipe, a drill head, a boring tool, an air compressor, air hose, and one or more pipe shaker apparatus. For example, FIG. 2 includes a pipe 200, a first drill head 210, a boring tool (not shown, see boring tool 630 of FIG. 6) within the pipe, an air compressor 230, an air hose 240, and one or more pipe shaker apparatus (not shown) within the pipe. The first drill head 210 is attached to the pipe 200 at a first end 220 of the pipe.

The pipe 200 may be comprised of various materials, including, for instance high-density polyethylene (HDPE), suitable for use in ground material applications. The diameter of the pipe may be selected based upon the amount of fluid or gas or the size of fiber optic cable, electrical cables, etc. that will be installed in the pipe. In one instance, where the pipe is to be used for a multi-channel ground loop for geothermal heating or cooling the diameter of the pipe may be 75.7 mm (2.5 inches) or more or less. The thickness of the walls of the pipe may be on the order of 2 mm or more or less to allow heat loss or gain with the ground material through the walls during operation of the ground loop. The length of pipe required may be at least half the length of the ground loop desired. In other words, the length of the pipe 200 may correspond to the depth of a hole to be drilled with some additional length required to attach to other components of a heating and/or cooling system at or near a second end 222 of the pipe.

The shape of a drilling portion 212 of the first drill head 210 may be selected with attributes suitable for creating a hole in the particular ground material that is being drilled. For instance, different shapes may be required for material such as sand, clay and rock. However, the first drill head may include at least a drilling portion that can create an opening or hole in the ground material using a hammering force.

Figure 3:
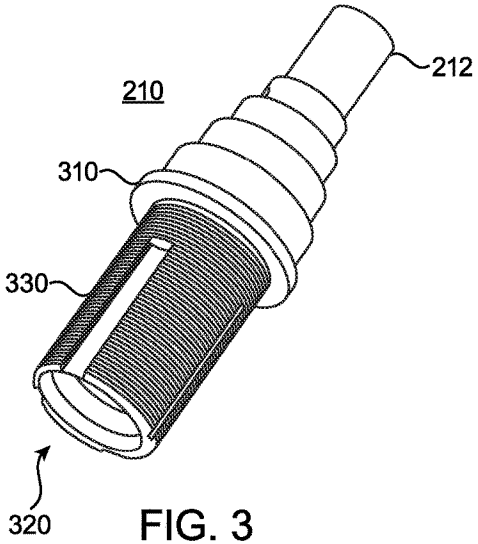
FIG. 3 is an example view of the first drill head of FIG. 2 in accordance with aspects of the disclosure.
Figure 4:
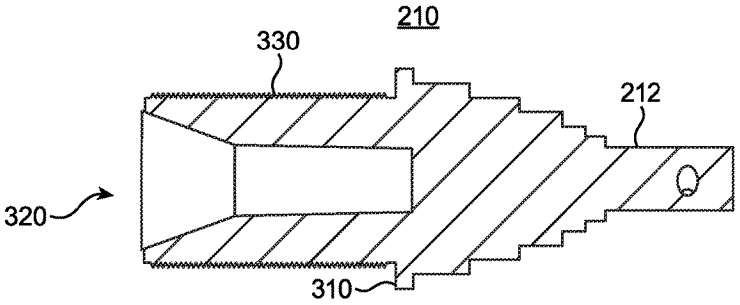
FIG. 4 is an example cross-sectional diagram of the first drill head of FIG. 3 in accordance with aspects of the disclosure.

FIG. 3 is an example view of first drill head 210 prior to attachment with the pipe 200. As shown, the first drill head may include a ridge section 310 around the drilling portion that overhangs the outer diameter of the pipe for at least some minimum distance, such as 1.35 mm or more or less, in order to reduce or prevent damage to the pipe during drilling. In addition, the first drill head may include an opening 320 sized to receive a second drill head of a boring tool discussed in further detail below.

Figure 2:
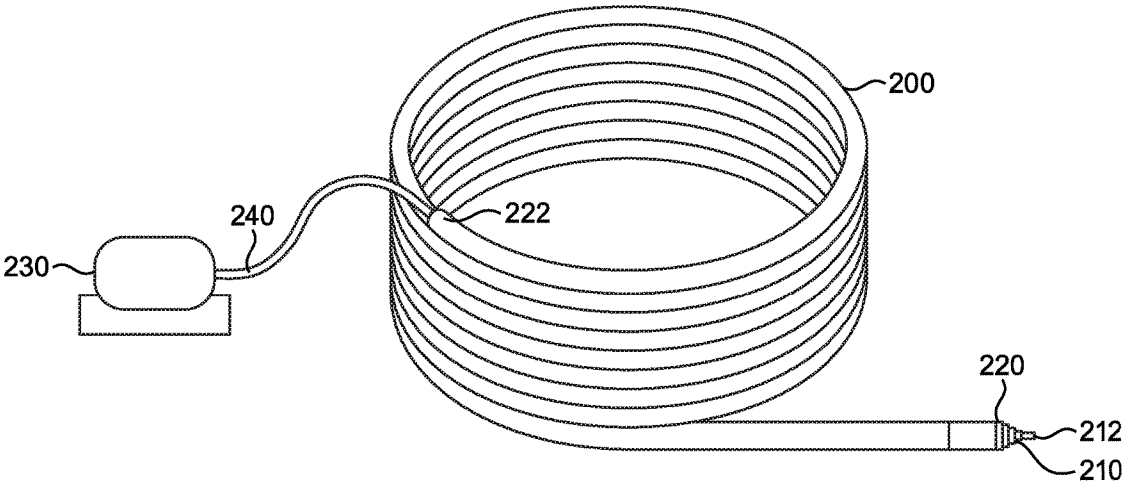
FIG. 2 is an example view of a pipe, drill head, air compressor, and air hose in accordance with aspects of the disclosure.

The first drill head also may include a thread-cutting interface 330 (shown in FIG. 3) for mating with an internal portion of the pipe in order to attach the first drill head to the pipe as is depicted in FIG. 2. As shown in FIG. 3, the thread-cutting interface at least partially surrounds an opening in the first drill head opposite of the drilling portion. Thus, threading may be cut into an internal surface 610 of the pipe 200 (shown in FIG. 6) by rotating the first drill head so that the thread-cutting interface cuts into the internal portion of the pipe. This cutting may create a threaded interface between the cut threading of the pipe and the thread-cutting interface of the first drill head. The threaded interface is thus a frictional seal between the pipe 200 and first drill head 210 which may prevent the first drill head from separating from the pipe during drilling.

Figure 5:
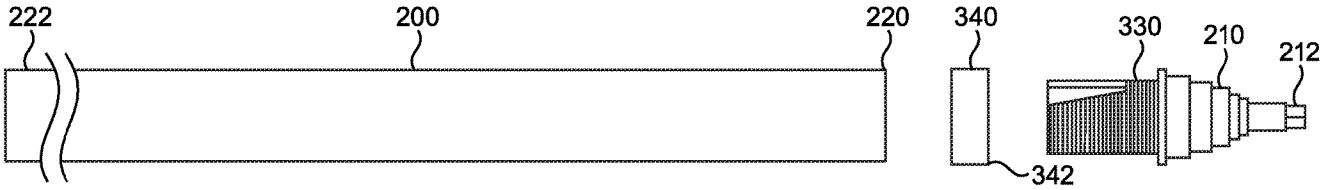
FIG. 5 is an example view of the pipe and first drill head in accordance with aspects of the disclosure.

To support the pipe in the area of the first drill head, prior to rotating the first drill head into the pipe, a collar may be placed around the pipe. For example, as shown in FIG. 5, collar 340 may be placed around the first end 220 of the pipe prior to attaching the first drill head 210 to the pipe. A first end 342 of the collar may also include an inner flange (not shown) that may keep the collar 340 in position at the first end of the pipe or in other words, keep the collar from moving too far towards the second end 222 of the pipe. The collar may help to prevent the pipe from flaring due to the cutting force of the thread-cutting interface 330, resulting in a more effective cut threading formed on the internal portion of the pipe.

In some examples, prior to attaching the first drill head to the pipe, a sealant material may be applied to the thread-cutting interface and/or the internal portion of the pipe (to be threaded). This sealant material may include, for instance, a multi-part resin, epoxy, silicone or other such material. The second removable tube may be arranged to provide the sealant pneumatically through a nozzle at the end of the second tube which, for instance, can be lowered towards the first drill head using an air hose. The sealant material may create a fluid tight seal between the pipe and the first drill head so that fluid within the pipe does not leak into the ground through the thread-cutting interface of the first drill head and cut threading of the pipe.

Figure 7:
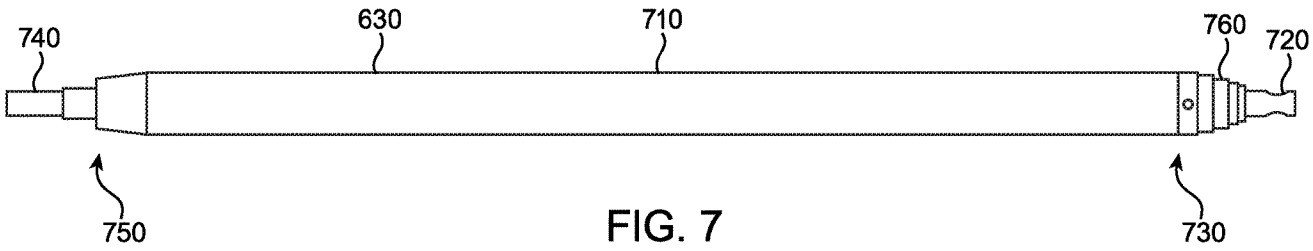
FIG. 7 is an example view of a boring tool in accordance with aspects of the disclosure.
Figure 8:
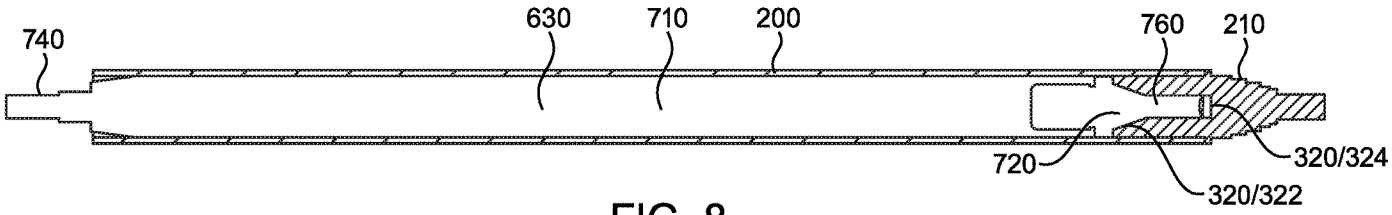
FIG. 8 is an example cross sectional view of the pipe and attached first drill head of FIG. 2 with the boring tool of FIG. 8 inserted therein.

Returning to FIG. 6, the pipe 200 may be configured with a hollow interior 620. The hollow interior may be sized to allow a boring tool 630, such as commercially available pneumatic boring tools offered by Grundomat®, to be placed within the pipe 200. FIG. 7 is a view of the boring tool 630, and FIG. 8 is a cross sectional view of the pipe 200 with the boring tool inserted therein. The boring tool may be configured as a tube 710 with a second drill head 760 (for instance, a pneumatic hammer) at a first end 730 of the tube and an air hose 740 (also shown in FIG. 2) attached to a second end 750 of the tube. The air hose 740 can be connected to an air compressor (not shown) outside of the pipe 200 in order to control the second drill head 860. The second drill head 760 may be a removable drill head that attaches and detaches from the boring tool 630 via threading (not shown).

Figure 6:
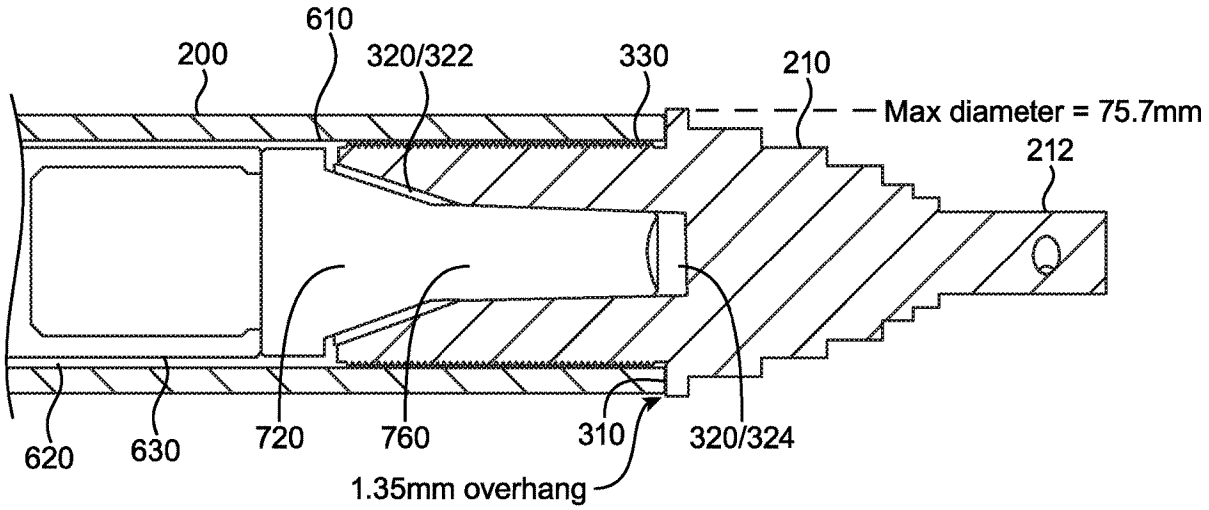
FIG. 6 is an example cross-sectional diagram of the pipe and attached first drill head of FIG. 2 in accordance with aspects of the disclosure.

A drilling portion 720 of the second drill head 760 may be positioned within the tube in order to mate with the opening 320 in the first drill head 210 (as shown in FIGS. 6 and 8). By doing so, the drilling portion 720 of the second drill head 760 can contact an interior of the first drill head proximate to the drilling portion 212 and force the drilling portion into the ground material via a locking fit between the second drill head 760 and the opening 320. As noted above, to facilitate the locking fit between the first and second drill heads, various locking mechanisms, such as a taper lock, ball lock (using a spring-loaded ball) or wedge lock (using a spring loaded piece in the shape of a wedge) may be used. This locking fit can cause the first drill head 210 to create an opening in the ground material. At the same time, the threaded interface between the pipe and the first drill head causes the moving first drill head to pull the pipe into and through that opening.

Figure 9:
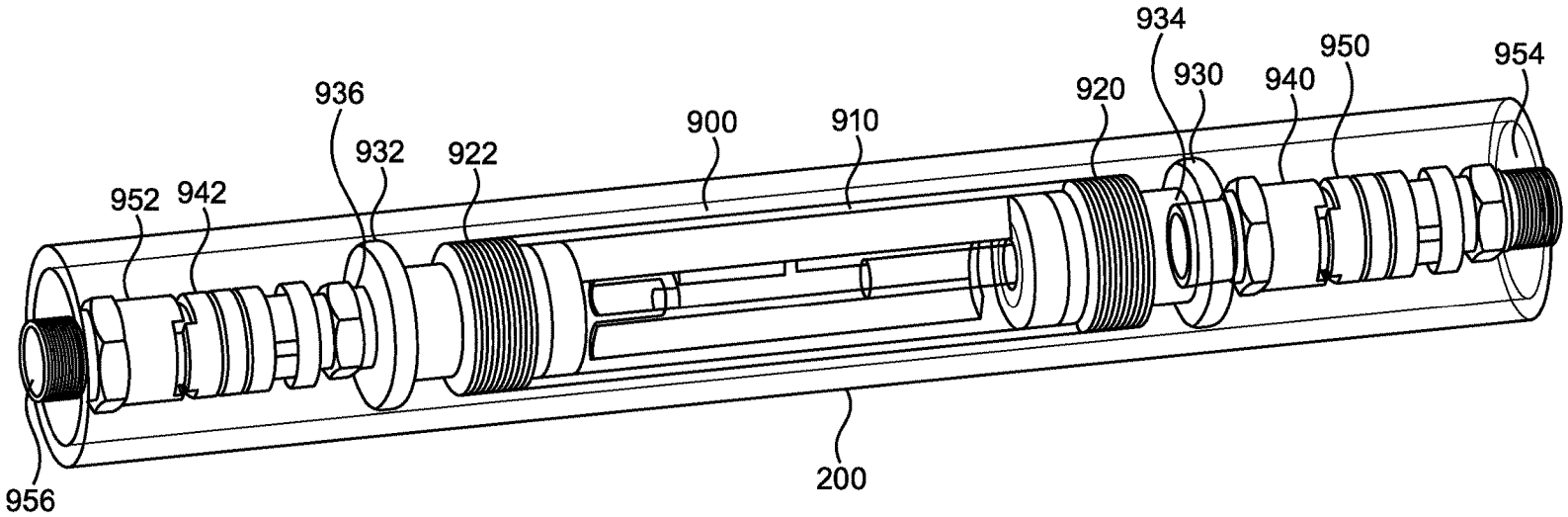
FIG. 9 is an example of a pipe shaker apparatus within a pipe in accordance with aspects of the disclosure.

An example pipe shaker apparatus can be configured to connect in line with the air hose. FIG. 9 is a view of a pipe shaker apparatus 900 within the pipe 200, in other words, pipe 200 is shown as translucent. The pipe shaker apparatus 900 includes opposing first and second ends 920, 922 of a tubular body 910. The first and second ends 920, 922 are each attached to a threaded end cap 930, 932. Threading 1002, 1004, shown in FIGS. 10 and 11, may connect the threaded end caps to an internal surface of the tubular body 910 (not shown in FIG. 10 or 11 for clarity) which may or may not include complementary threading. The threaded end caps 930, 932 are each attached via internal threading (not shown) to threading 934, 936 of a connection device 940, 942. The threaded end caps have openings 1710, 1712 (shown in FIG. 17) which allow air to pass through and are configured hold an offset mass within the tubular body.

Figure 10:
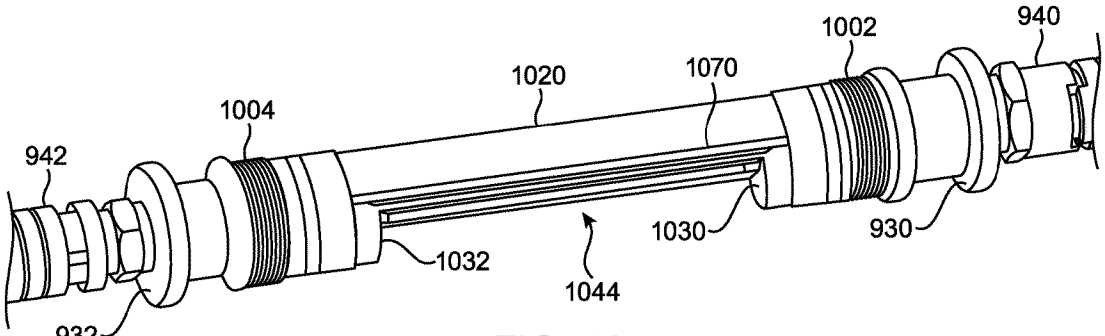
FIGS. 10-11 are partial views of a pipe shaker apparatus in accordance with aspects of the disclosure.
Figure 11:
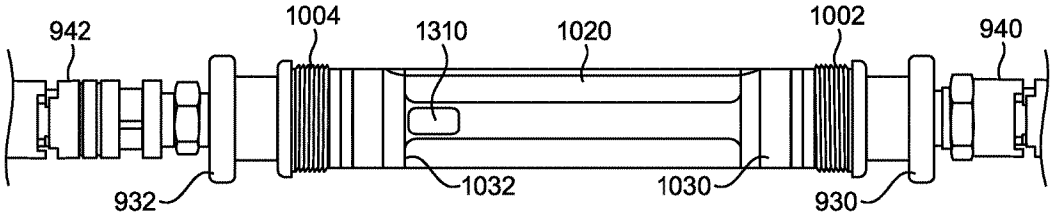
Figure 12:
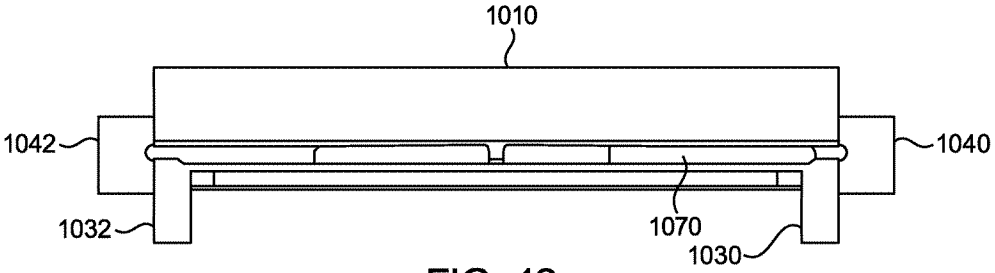
FIGS. 12-16 are views of a rotor in accordance with aspects of the disclosure.
Figure 13:
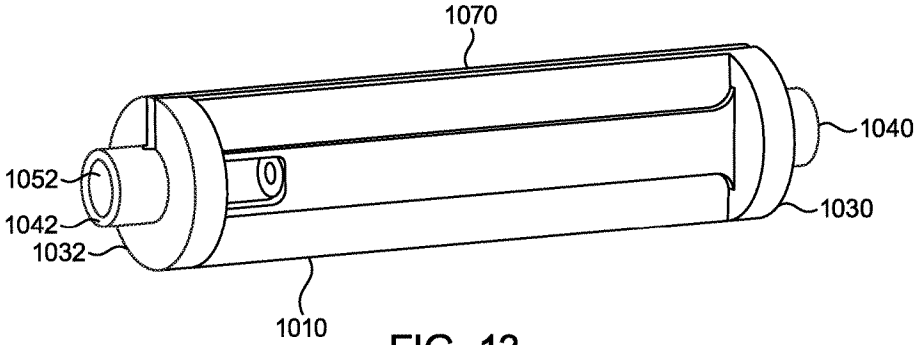

The connection devices 940, 942 are depicted as a quick connect fittings in FIGS. 9-11. In FIG. 9, each quick connect fitting 940, 942 is shown attached to another quick connect fitting 950, 952 which can be attached via threading 954, 956 to a portion of the air hose (not shown). The quick connect fitting may allow each end of the pipe shaker apparatus to connect with a corresponding connection device (e.g. a quick connect fitting). In this regard, a plurality of pipe shaker apparatus can be connected in line with the compressed air hose quickly and easily. As an example, the pipe shaker apparatus can be connected in line with the air hose via the connection devices every 10 to 20 feet or more or less, or rather, the pipe shaker apparatus 900 can be connected to 10 foot pieces of air hose.

The pipe shaker apparatus 900 may be sized to fit within the pipe 200 as shown in FIG. 9. For instance, the greatest width dimension of the pipe shaker apparatus may be such that the pipe shaker apparatus is at least 1 mm narrower than the internal diameter of the pipe. This allows the pipe shaker apparatus to move within the pipe without causing too much friction between the pipe shaker apparatus and the pipe, and also allows the pipe shaker apparatus to move within the pipe even when there is some small bends in the pipe.

Figure 15:
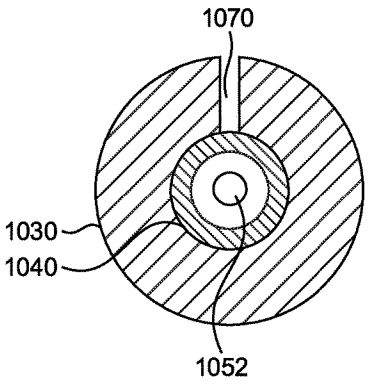
Figure 14:
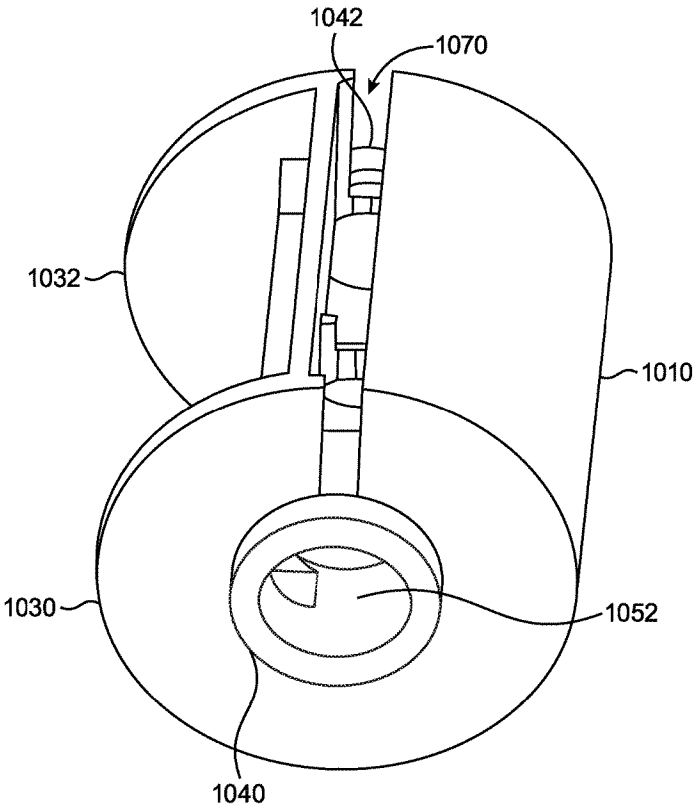
Figure 16:
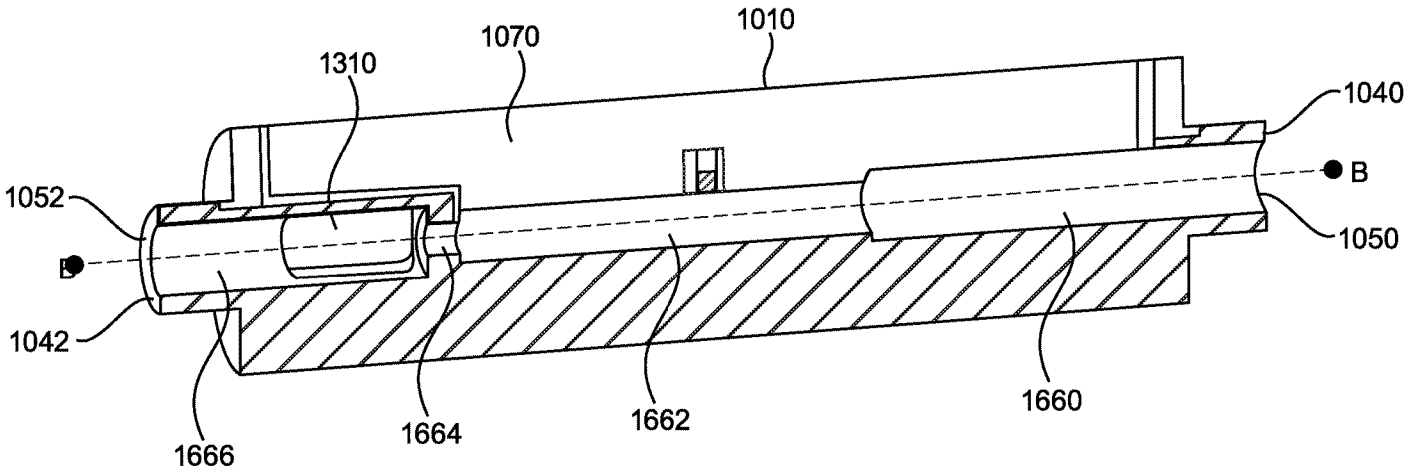

Within the tubular body is an offset mass (shown in FIGS. 10-16 no tubular body 910 being shown in these FIGURES for clarity) attached to each of the threaded end caps. The offset mass may be configured as a rotor 1020. Referring to the various views of the rotor 1020 depicted in FIGS. 12-16 (FIG. 16 being a cross-sectional view through A-A of FIG. 15). The rotor has a generally cylindrical shape. In this regard, the shape of the rotor includes two circular end pieces 1030, 1032 connected to one another by an extension 1010. The relative arrangement of the extension between the circular end pieces creates the offset mass of the rotor. In other words, the mass of the extension 1010 is offset from an axis (B-B in FIG. 16) through a center of each of the circular end pieces 1030, 1032. When the rotor is within the tubular body, the area apart from the circular end pieces 1030, 1032 and extension 1010 forms a void (see void 1044 of FIG. 10) between the rotor and the tubular body.

Each circular end pieces includes a cylindrical extension that extends away from the circular end pieces and has an opening there through. As shown in FIGS. 12-15, the circular end pieces 1030, 1032 each include a cylindrical extension 1040, 1042 with openings 1050, 1052 (shown most clearly in FIG. 14). The openings are connected via a series of internal passages 1660, 1662, 1664, 1666. To allow for the vane 1060 to rotate the rotor (as discussed further below), a portion of one of the internal passages, internal passage 1662 (see FIG. 10) may be blocked, such as by using a set screw, plug or other air blocking device (1740 of FIG. 17) in order to force air into the void 1044 so that the air moves around the vane and enters internal passage 1666 through opening 1310 (shown most clearly in FIG. 13).

In one example, the rotor may include an attached vane 1060 as shown in FIGS. 10 and 11. To allow for placement of the vane, the rotor may include a slot 1070. The slot 1070 may pass through both of the circular end pieces 1030, 1032 as well as the extension 1010.

Example Methods

In addition to the operations described above and illustrated in the figures, various operations will now be described. It should be understood that the following operations do not have to be performed in the precise order described below. Rather, various steps can be handled in a different order or simultaneously, and steps may also be added or omitted.

Figure 17:
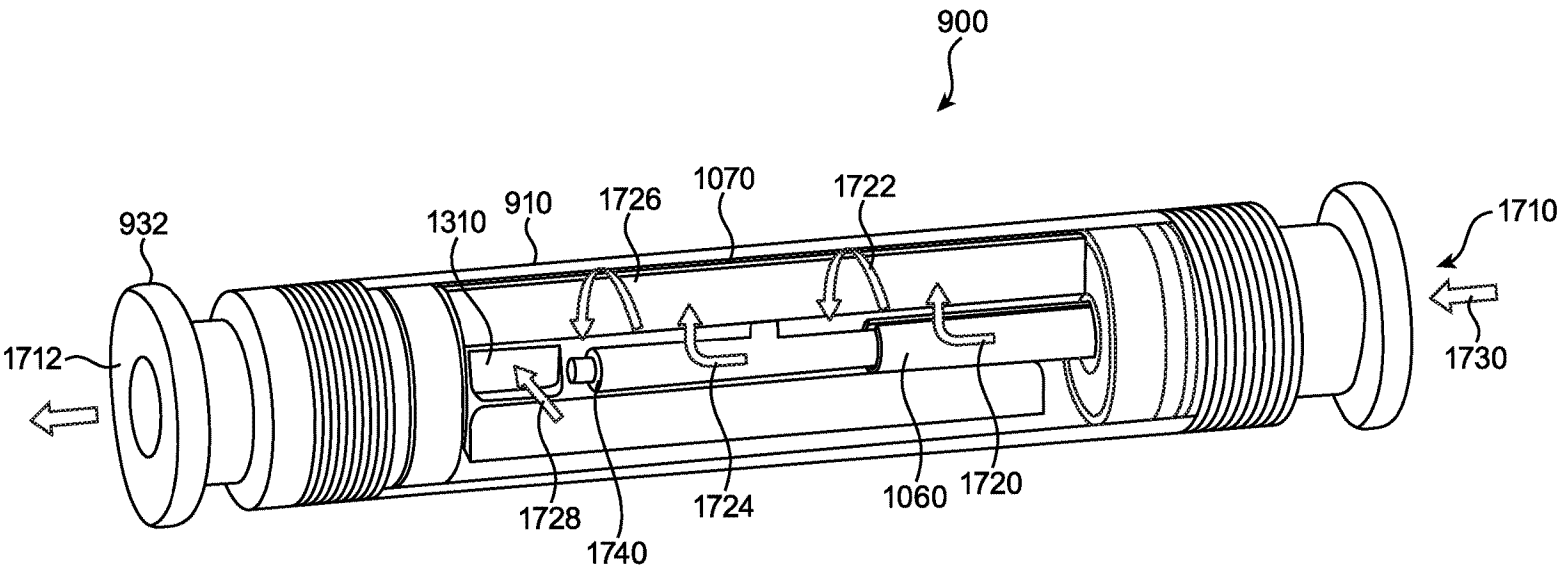
FIG. 17 is another example of a pipe shaker apparatus in accordance with aspects of the disclosure.

Referring to FIG. 17, compressed air may be forced through the quick connect fitting 940 and thereafter enters and moves through the opening 1710 of threaded end cap 930 and into the tubular body 910 as indicated by arrow 1730. From the opening 1710, the air passes through the opening 1050 in cylindrical extension 1040. The air then moves through internal passage 1660 and around the extension 1010 as indicated by arrows 1720 and 1722. The air moving around the extension then creates a force on the vane 1060 which deflects some of the air back towards passage 1662 as indicated by arrows 1724 and 1726 and some of the air enters the void 1044. The force on the vane caused by the moving air moves the vane which sweeps against the inner wall of the tubular body. At the same time, the vane pulls the rotor along with the vane such that both the vane and the rotor rotate.

The deflected air continues to move around the extension 1010 until the air passes into opening 1310 and moves into passage 1666 as indicated by arrow 1728. From there, the air passes through the opening 1052 in cylindrical extension 1042 and exits the pipe shaker apparatus through opening 1712 of the threaded end cap 930 as indicated by arrow 1732.

In order to place the pipe 200 in the ground material, a first drill head may be connected to a pipe. For example, a first drill head 210 may be attached to the first end 220 of the pipe 200. The thread-cutting interface 330 may cut into the internal surface 610 of the pipe by rotating the first drill head. Once the first drill head 210 is fully inserted into the pipe 200, the ridge section 310 may contact the pipe as shown, for instance in FIGS. 2, 6, and 9.

Next, the pipe shaker apparatus may be connected to sections of air hose. As discussed above, this may be achieved by connecting the quick connect fittings 940, 942 of a number of the pipe shaker apparatus 900 with the corresponding quick connect fittings 950, 952 attached to sections of air hose. The length of the air hose sections may be and the number of pipe shaker apparatus and sections of air hose used may vary depending upon the desired depth of length of pipe needed for the particular implementation.

The boring tool, pipe shaker apparatus and air hose may be inserted into the pipe. For instance, boring tool 630 with air hose 740 may be inserted into the second end 222 of the pipe 200 and moved towards the first end 220 until the boring tool reaches the first drill head as shown in FIG. 9. At this point, the second drill head 860 can move through the first chamber 322 and into the second chamber 324 thereby forming the locking fit.

The first drill head, second drill head, and pipe may then be used to create an opening in the ground material. For instance, the drilling portion 212 may be placed at or close to 90 degrees against the surface of the ground material at the desired location for a loop. The air compressor can be used to control the boring tool 630 to move the second drill head 860 within the pipe. The second drill head 860 may then create a hammering force on the interior of the first drill head proximate to the drilling portion 212. This hammering force causing the drilling portion to pound into the ground material, creating an opening in the ground material. Additional hammering may cause the drilling portion 212 to enter into the opening, pulling the first end 220 of the pipe along with the first drill head (because of the connection between these features).

Figure 18:
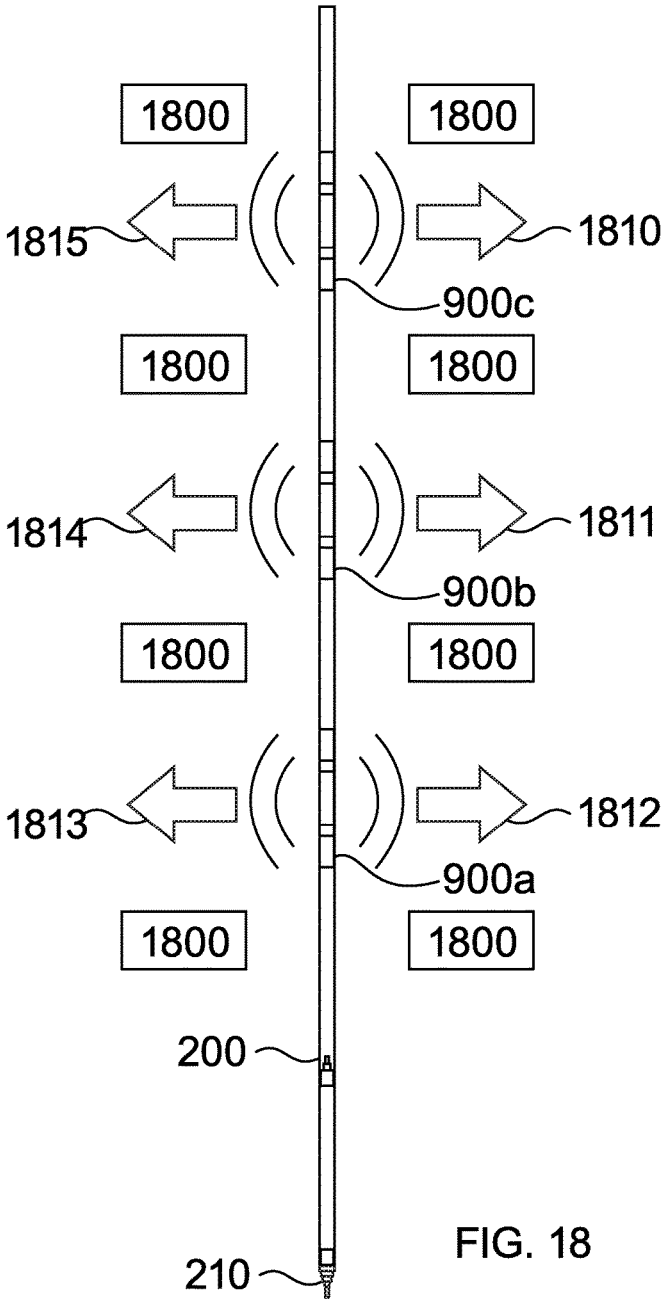
FIG. 18 is an example view of a pipe and drill head in ground material in accordance with aspects of the disclosure.

At the same time, the pipe shaker apparatus may be used to reduce the friction between the pipe and the ground material. FIG. 18 is an example view of pipe 200 in ground material 1800 (the same or similar to ground material 100 of FIG. 1). Within pipe 200 are a series of pipe shaker apparatuses 900 (900*a*, 900*b*, 900*c*) connected to one another in series via sections of air hose (not shown). Rotation of the rotor as discussed above causes the pipe shaker apparatus to "wobble" within the pipe 200. This motion causes the pipe shaker apparatus to come in contact with the interior of the pipe 200 vibrating the pipe and the ground material 1800 surrounding the pipe as represented by arrows 1810-1815. The vibrations reduce friction between the pipe and the ground thereby making it easier for the pipe 200 to move through the opening created by the drilling head.

The movement of the vane 1060 can be powered by compressed air from the air hose which also powers the boring tool 630. For instance, each of the openings 1050, 1052 in the cylindrical extensions 1040, 1042 may be connected to openings which extend from the threaded end caps and through the quick connect fittings 950, 952. Compressed air from the air hose can pass through a quick connect fitting attached to the air hose and into the quick connect fitting 950. The air may then be deflected, as noted above, causing the pipe to vibrate and exit the pipe shaker apparatus via quick connect fitting 952 and entering another section of air hose through another quick connect fitting attached to that section of air hose. Eventually the compressed air will reach the boring tool 630 forcing the drill head against the ground material in a hammering action and creating an opening in the ground material.

The hammering of the drill head and the vibrating of the pipe shaker apparatus can continue until a desired depth of the opening is reached. The first and second drill heads may then be released from one another. As an example, the boring tool may be reversed, for instance by twisting the compressed air hose that controls the boring tool, the forces are reversed and the taper lock is knocked loose. This allows the boring tool to be pulled out of the pipe via the air hose or by an attached cable or chain for this purpose. As an example, the chain or cable may be made of steel to ensure strength and stability. At this point, the boring tool and air hose may be removed from the pipe.

Once the desired depth or distance for the opening has been reached, the compressed air hose, pipe shaker apparatus, and impact hammer can be removed from the pipe. Of course, along the way, especially where the pipe is not perfectly straight, the pipe shaker apparatus may tend to get stuck within the pipe. To address this, compressed air may be used to rotate the rotor and wobble the pipe shaker apparatus within the pipe. Again, this can cause the pipe shaker apparatus to vibrate the pipe, reducing the friction between the pipe shaker apparatus and the pipe, and allowing the pipe shaker apparatus to be more easily removed from the pipe.

Figure 19:
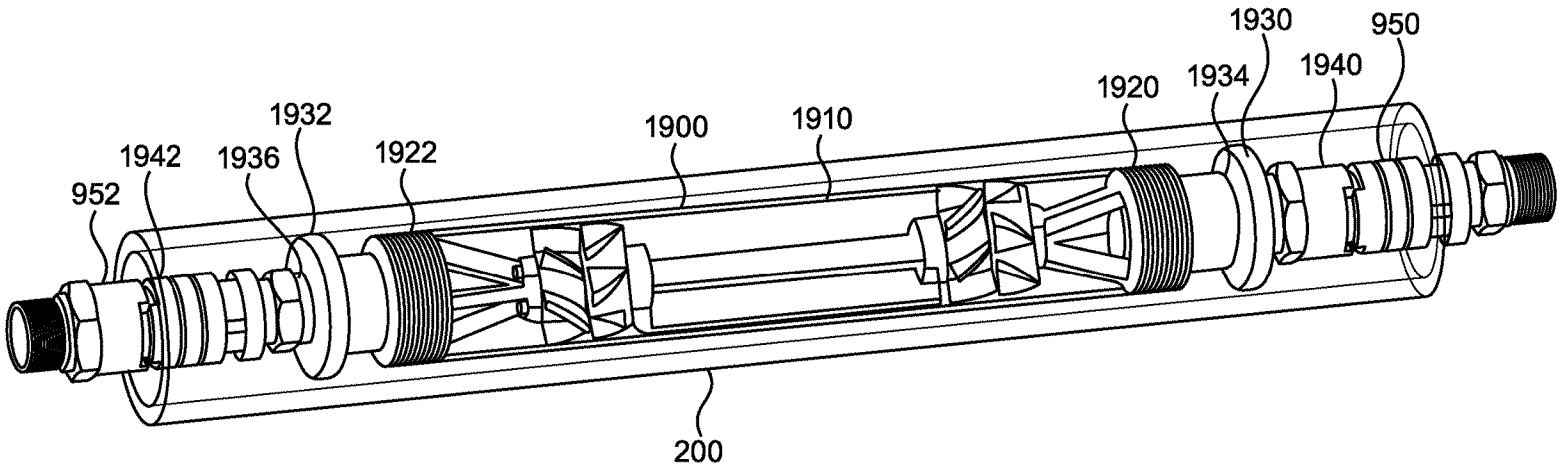
FIG. 19 is an example of a pipe shaker apparatus within a pipe in accordance with aspects of the disclosure.
Figure 22:
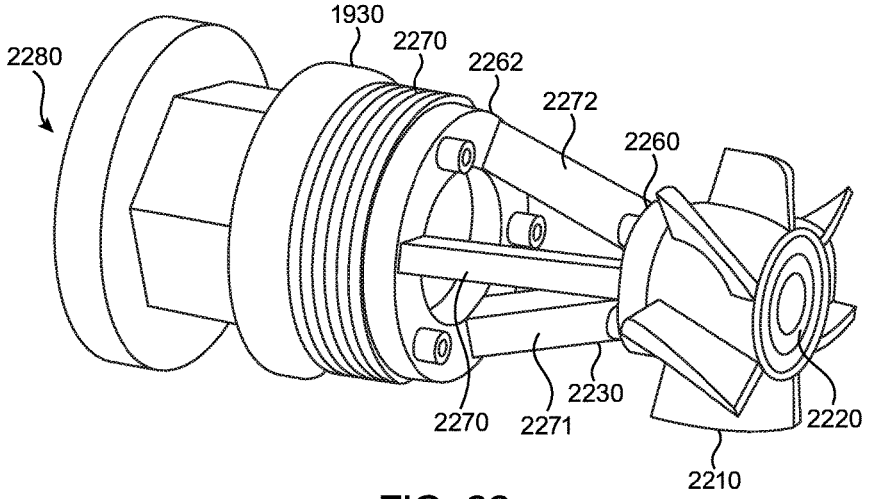
FIGS. 22-23 are views of end caps with attached stator brackets and fixed stator propellers in accordance with aspects of the disclosure.
Figure 23:
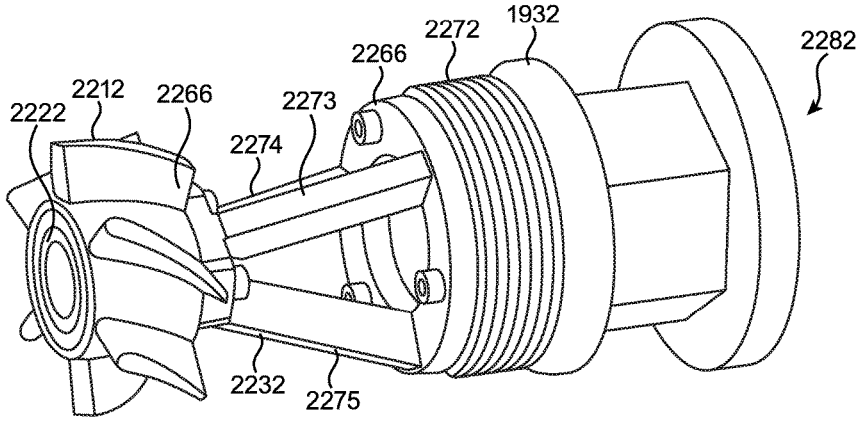

Rather than using a vane to rotate an offset mass within a tubular body, the ends of the rotor may be configured with rotor propellers. For instance, FIG. 19 is a view of a pipe shaker apparatus 1900 that may be configured similarly to pipe shaker apparatus 900. The pipe shaker apparatus 1900 includes opposing first and second ends 1920, 1922 of a tubular body 1910, similar to first and second ends 920, 922 of a tubular body 910. The first and second ends 1920, 1922 are each attached to a threaded end cap 1930, 1932 similar to threaded end caps 930, 932. Threading 2270, 2272, (similar to threading 1004, 1006) shown in FIGS. 22 and 23, may connect the threaded end caps to an internal surface of the tubular body 1910 (not shown in FIGS. 20-23 for clarity) which may or may not include complementary threading. The threaded end caps 1930, 1932 are each attached via internal threading (not shown) to threading 1934, 1936 of a connection device 1940, 1942. The threaded end caps have openings 2280, 2282 (similar to openings 1710, 1712) shown in FIGS. 22 and 23, which allow air to pass through and are configured hold an offset mass within the tubular body.

Again, similar to connection devices 940, 942, connection devices 1940, 1942 may be a quick connect fittings. In FIG. 19, each quick connect fitting 1940, 1942 is shown attached to another quick connect fitting 950, 952 which can be attached via threading 954, 956 to a portion of the air hose (not shown). Again, the quick connect fittings allow each end of the pipe shaker apparatus to connect with a corresponding connection device (e.g. a quick connect fitting). In this regard, a plurality of the pipe shaker apparatus 1900 and/or 900 can be connected in line with the compressed air hose quickly and easily. As an example, the pipe shaker apparatus can be connected in line with the air hose via the connection devices every 10 to 20 feet or more or less, or rather, the pipe shaker apparatus 1900 and/or 900 can be connected to 10 foot pieces of air hose.

As with pipe shaker apparatus 900, pipe shaker apparatus 1900 may be sized to fit within the pipe 200 as shown in FIG. 19. For instance, the greatest width dimension of the pipe shaker apparatus 1900 may be such that the pipe shaker apparatus is at least 1 mm narrower than the internal diameter of the pipe. This allows the pipe shaker apparatus 1900 to move within the pipe 200 without causing too much friction between the pipe shaker apparatus and the pipe, and also allows the pipe shaker apparatus to move within the pipe even when there is some small bends in the pipe.

Figure 20:
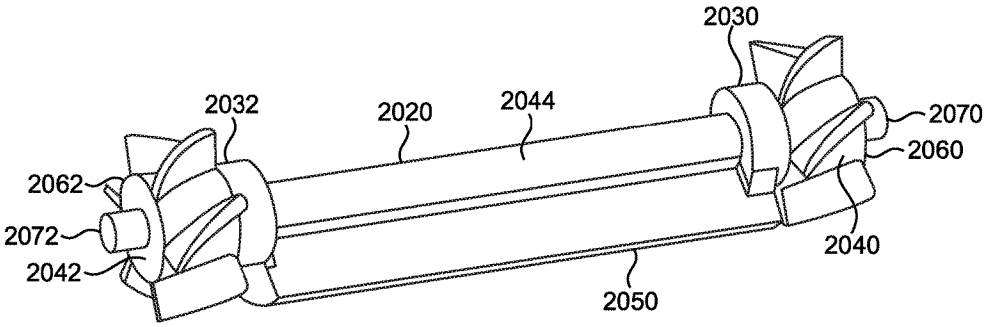
FIG. 20-21 is a partial views of a pipe shaker apparatus in accordance with aspects of the disclosure.
Figure 21:
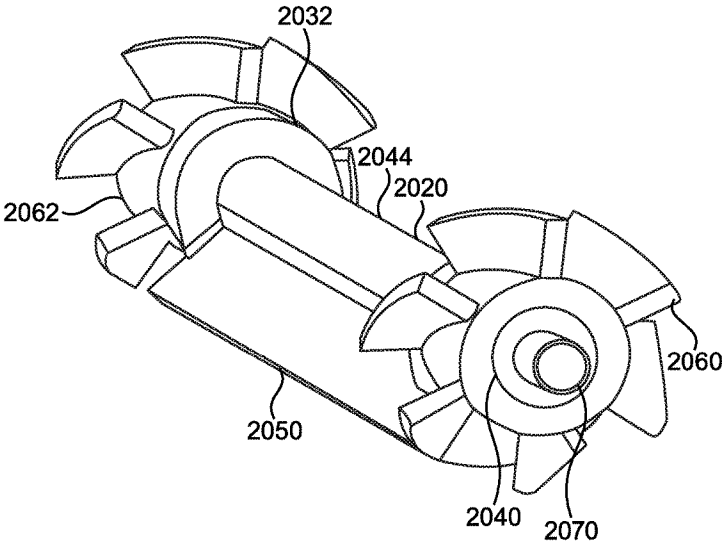

Pipe shaker apparatus 1900 also includes an offset mass. The offset mass may be configured as a rotor 2020 as is shown in FIGS. 20 and 21. Like rotor 1020, rotor 2020 includes two circular end pieces 2030, 2032 connected to one another. However, the extension between the circular end pieces 2030, 2032 includes a cylindrical rod 2044 with an extension 2050 that extends beyond the edge of the circular end pieces. The shape and positioning of the extension creates an offset mass. In other words, the mass of the extension 2050 is offset from an axis through a center of each of the secondary cylindrical extension 2070, 2072.

The circular end pieces 2030, 2032 each include a cylindrical extension 2040, 2042. A rotor propeller 2060, 2062 is fixed to each of the cylindrical extensions. Unlike the those of pipe shaker apparatus 900, the cylindrical extensions 2040, 2042 of pipe shaker apparatus 1900 do not include openings there through. However, each cylindrical extension 2040, 2042 is attached to a secondary cylindrical extension 2070, 2072 which is sized to fit into a respective fixed stator propeller 2210, 2212 (shown in FIGS. 22 and 23) and rotate therein.

As an example, each stator propeller may include a ball bearing 2220, 2222 which allows a secondary cylindrical extension to rotate within the respective fixed stator propeller 2210, 2212. Each respective fixed stator propeller is attached to a stator bracket 2230, 2232 via screws or bolts. Referring to stator bracket 2230, each of the stator brackets are configured as a pair of differently-sized circular rings or discs 2260, 2262, 2264, 2266 with opening there through with three linear supports 2270-2275 connecting the pair of rings in a tri-pod arrangement. Each stator bracket 2230, 2232 is then connected to one of the threaded end caps 1930, 1932 (shown connected in FIG. 19) for instance, via screws or bolts.

As can be seen from FIG. 19, each of the respective fixed stator propellers 2210, 2212 and rotor propeller 2060, 2062 includes a set of blades. The blades of the respective fixed stator propellers are oriented or curved to move air in a first direction, while the blades of the rotor propellers are oriented in a second direction different from the first direction. In other words, the blades of the respective fixed stator propellers are oriented opposite of the blades of the rotor propellers.

Figure 24:
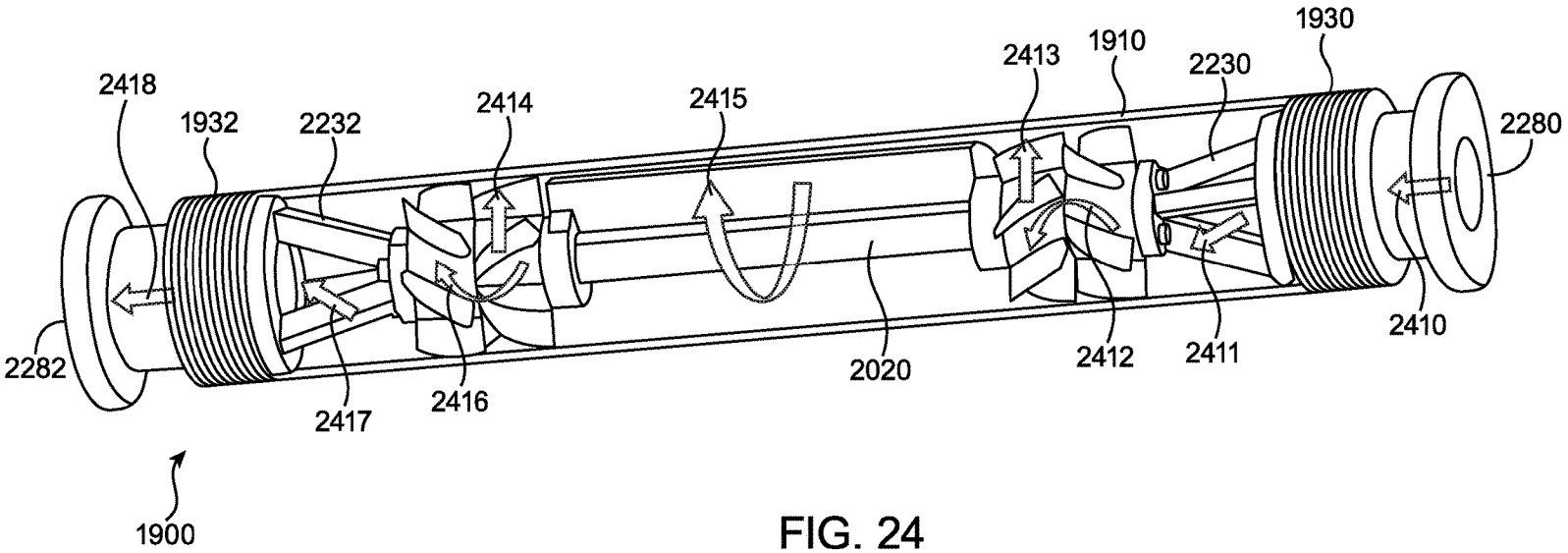
FIG. 24 is another example of a pipe shaker apparatus in accordance with aspects of the disclosure.

Turning to FIG. 24, in operation, compressed air enters and moves through the threaded end cap 1930 via opening 2210 as indicated by arrow 2410. The air then passes through the opening in ring 2260 (and around ring 2260) within the tubular body 1910 and is deflected by the linear supports 2270-2272 of the stator bracket 2230 and fixed stator propeller 2210 as indicated by arrows 2411, 2412. The deflected air then creates a force on the rotor propeller 2060 and eventually also rotor propeller 2062 as indicated by arrows 2413, 2414. These force on the rotor propellers causes the rotor propellers to rotate. Because the rotor propeller is fixed to the rotor, this causes the rotor to rotate as indicated by arrow 2415.

The air continues to move through the tubular body 1910 being again deflected by the blades of fixed stator propeller 2262 as indicated by arrow 2416. From there, the air moves around the linear supports 2273-2275 of stator bracket 2232 and passes through the opening of ring 2262 as indicated by arrow 2417. The air then exits the pipe shaker apparatus 1900 through opening 1712 of the threaded end cap 1930 as indicated by arrow 2418.

Figure 25:
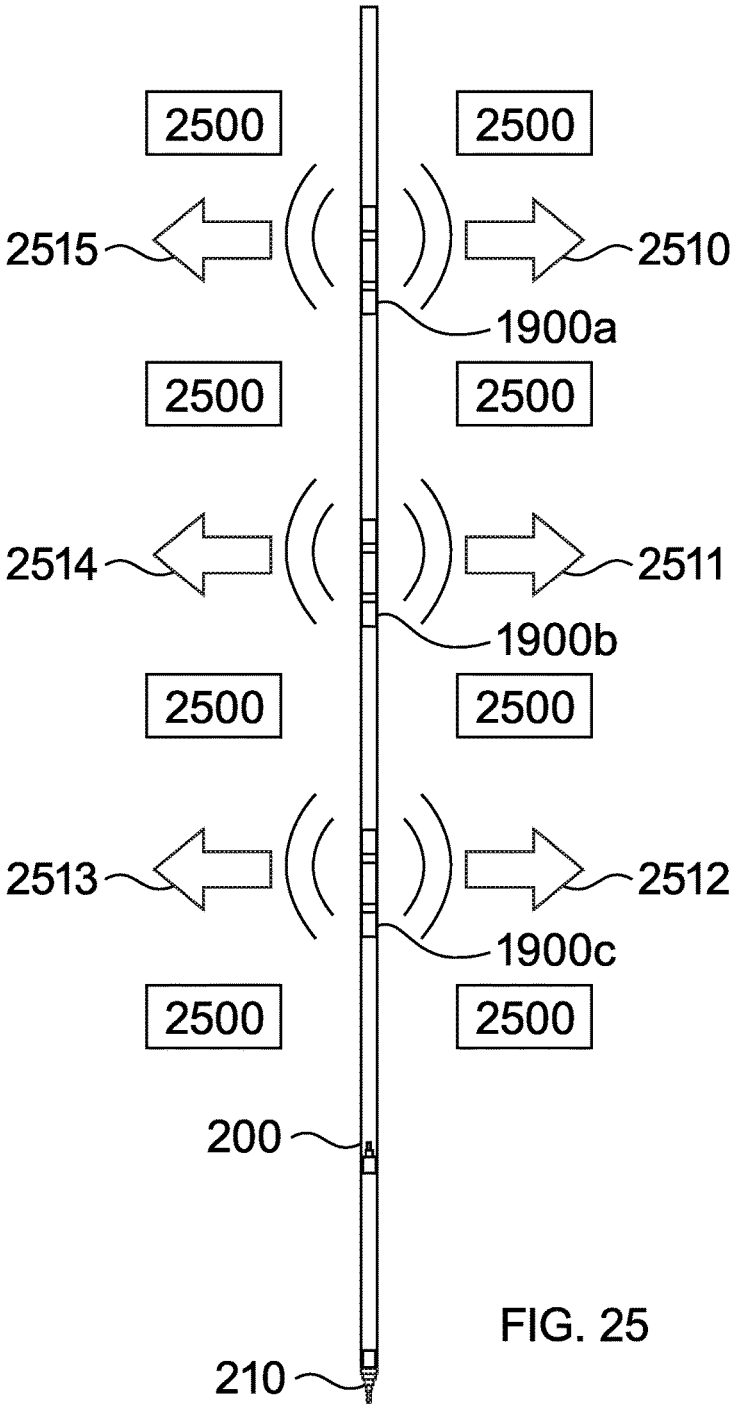
FIG. 25 is an example view of a pipe and drill head in ground material in accordance with aspects of the disclosure.

One or more pipe shaker apparatuses 1900 (and/or pipe shaker apparatus 900) may be connected to quick connect device 950, 952 of a portion of air hose and inserted into pipe 200 in order to reduce the friction between the pipe and the ground material. FIG. 25 is an example view of pipe 200 in ground material 2500 (the same or similar to ground material 100 or 1800 of FIGS. 1 and 1800). Within pipe 200 are a series of pipe shaker apparatus 1800 (1800*a*, 1800*b*, 1800*c*) connected to one another in series via sections of air hose (not shown). Rotation of the rotor propellers 2060, 2062 and rotor 2020 as discussed above, causes the pipe shaker apparatus 1220 (and/or 900) to "wobble" within the pipe 200. This motion causes the pipe shaker apparatus to come in contact with the interior of the pipe 200 vibrating the pipe and the ground material 2500 surrounding the pipe as represented by arrows 2510-2515. The vibrations reduce friction between the pipe and the ground thereby making it easier for the pipe 200 to move through the opening created by the drilling head.

The movement of the propellers can be powered by compressed air from the compressed air hose as shown in FIG. 24. Air from the compressed air hose can pass through the quick connect fittings and into the threaded end caps. The air may then be deflected, as noted above, causing the rotor 2020 to rotate and the pipe 200 to vibrate.

Because the compressed air is able to move around and through the pipe shaker apparatus 900 and 1900 quickly, the pressure drop at each pipe shaker apparatus along the length of the pipe 200 may be minimal. However, some air compressors may be adjusted in order to increase the pressure of the compressed air to account for the pressure difference while still being within pressure tolerances of the air hose. For instance, if the desired air pressure at the impact hammer is 100 PSI, this could be increased incrementally for every pipe shaker apparatus attached to the compressed air hose. Of course, too much pressure may cause failures at other portions of the system, such as the pipe, the drilling head, the impact hammer, etc.

In some examples, to decrease the distance between the pipe shaker apparatus and the pipe during use, and therefore have greater vibration effect on the pipe, the pipe shaker apparatus may include additional spring loaded features which extend away from the pipe shaker apparatus and towards the interior pipe wall. As with the rotor, the spring loaded features may be powered by the compressed air. In other words, the compressed air may cause the spring loaded features to move towards the interior surface of the pipe.

While compressed air can be used to power the pipe shaker apparatus 900 and 1900, they may alternatively be powered by hydraulics, an electric motor, or other mechanical means. For instance, the rotor may be configured to allow the compressed air to pass directly between the openings of the circular end pieces. A small battery powered electric motor may then be used to rotate the offset mass. Again, rotation of the rotor with its offset mass would cause the pipe shaker apparatus to wobble and vibrate the pipe. In such an example, the vane or propellers may not be required.

Although the technology described herein has been described with reference to particular embodiments, it is to be understood that these embodiments are merely illustrative of the principles and applications of the present disclosure. It is therefore to be understood that numerous modifications may be made to the illustrative embodiments and that other arrangements may be devised without departing from the spirit and scope of the present disclosure as defined by the appended claims.

The invention claimed is:

1. A system comprising:

a pipe shaker apparatus configured to shake within a pipe to cause the pipe to vibrate, the pipe shaker apparatus including:

a rotor having an offset mass, wherein the offset mass is offset from a longitudinal axis through a first end piece of the rotor at a first end of the rotor and a second end piece of the rotor at a second end of the rotor, wherein the first end and second ends of the rotor are opposite one another;

a tubular body having first and second ends; and a first end cap arranged at the first end of the tubular body and a second end cap arranged at the second end of the tubular body such that air is able to pass through the first end cap, enter the tubular body, cause the rotor to rotate, and exit the tubular body through the second end cap, and wherein the rotor is arranged within the tubular body such that rotation of the rotor by the air causes the offset mass to shake the pipe shaker apparatus;

wherein the first end cap includes a first cylindrical extension having an opening there through, and the second end cap includes a second cylindrical extension having an opening there through, and wherein the opening of the first cylindrical extension is connected to the opening in the second cylindrical extension by way of a set of passages; and the apparatus further comprising an air blocking structure arranged to block one of the set of passages in order to limit air passing directly through the opening of the first cylindrical extension to the opening in the second cylindrical extension by way of the set of passages.

2. The system of claim 1, further comprising a pair of rotor propellers fixed to the rotor such that rotation of the pair of rotor propellers causes the rotor to rotate with the pair of rotor propellers.

3. The system of claim 2 wherein each rotor propeller of the pair of rotor propellers is adjacent to a respective stator propeller.

4. The system of claim 1 wherein the rotor is arranged such that an area between the first end piece and the second end piece creates a void between the offset mass and an interior surface of the tubular body.

5. The system of claim 1 wherein the rotor includes a slot extending through and between each of the first and second end pieces.

6. The system of claim 1 wherein the first end cap includes a first cylindrical extension having an opening there through, and the second end cap includes a second cylindrical extension having an opening there through.

7. A system comprising:

a pipe shaker apparatus configured to shake within a pipe to cause the pipe to vibrate, the pipe shaker apparatus including:

a rotor having an offset mass, wherein the offset mass is offset from a longitudinal axis through a first end piece of the rotor at a first end of the rotor and a second end piece of the rotor at a second end of the rotor, wherein the first end and second ends of the rotor are opposite one another;

a tubular body having first and second ends;

a first end cap arranged at the first end of the tubular body and a second end cap arranged at the second end of the tubular body such that air is able to pass through the first end cap, enter the tubular body, cause the rotor to rotate, and exit the tubular body through the second end cap, and wherein the rotor is arranged within the tubular body such that rotation of the rotor by the air causes the offset mass to shake the pipe shaker apparatus; and a pair of rotor propellers fixed to the rotor such that rotation of the pair of rotor propellers causes the rotor to rotate with the pair of rotor propellers, wherein each rotor propeller of the pair of rotor propellers is adjacent to a respective stator propeller.

8. The system of claim 7, wherein the rotor is arranged such that an area between the first end piece and the second end piece creates a void between the offset mass and an interior surface of the tubular body.

9. The system of claim 7, wherein the rotor includes a slot extending through and between each of the first and second end pieces.

10. The system of claim 9, further comprising a vane arranged within the slot such that air passing through the tubular body causes the vane to sweep against an interior surface of the tubular body which causes the rotor to rotate.

11. The system of claim 7, wherein the first end cap includes a first cylindrical extension having an opening there through, and the second end cap includes a second cylindrical extension having an opening there through.

12. The system of claim 11, wherein the opening of the first cylindrical extension is connected to the opening in the second cylindrical extension by way of a set of passages.

13. The system of claim 7, wherein a first end of the pipe shaker apparatus includes a first quick connect device and a second end of the pipe shaker apparatus includes a second quick connect device.

14. The system of claim 13, further comprising an air hose having a third quick connect device such that the air hose and the pipe shaker apparatus are configured to be connected to one another by way of the first and third quick connect devices.

15. The system of claim 14, further comprising a set of compressed air hose sections wherein the first quick connect device and the second quick connect device allow the pipe shaker apparatus to be connected in line with the set of compressed air hose sections.

16. The system of claim 7, further comprising the pipe.

17. The system of claim 16, further comprising a drilling head attached to the pipe.

18. The system of claim 7, wherein each respective stator propeller is attached to a stator bracket that connects to one of the first or second end caps.

19. The system of claim 18, wherein each stator bracket includes a pair of rings connected to one another by a linear support.

20. The system of claim 18, further comprising a ball bearing connecting one of the respective stator propellers to one of the rotor propellers to allow the one of the pair of rotor propellers to rotate within the one of the respective stator propellers.

* * * * *